US007334853B2

(12) United States Patent
Ahmed et al.

(10) Patent No.: US 7,334,853 B2
(45) Date of Patent: Feb. 26, 2008

(54) REFRIGERATOR DOOR BEVERAGE STORAGE MODULE

(75) Inventors: Rania Mohanna Ahmed, Louisville, KY (US); Wayne Edward Lawson, LaGrange, KY (US); Venkata Ramakrishna Ramayanam, Richmond Heights, OH (US); Esther Savitri Jasper, Louisville, KY (US); Vijaykumar Mallappa Kannure, Sangli (IN); Premkumar Gangadhar, Karnataka (IN)

(73) Assignee: General Electric Company, Schenectady, NY (US)

( * ) Notice: Subject to any disclaimer, the term of this patent is extended or adjusted under 35 U.S.C. 154(b) by 202 days.

(21) Appl. No.: 10/394,457

(22) Filed: Mar. 19, 2003

(65) Prior Publication Data

US 2004/0183417 A1 Sep. 23, 2004

(51) Int. Cl.
*A47B 96/16* (2006.01)

(52) U.S. Cl. ..... 312/405.1; 211/106

(58) Field of Classification Search ..... 312/401, 312/404, 405, 405.1, 408, 321.5; 211/74, 211/75, 90.01, 90.03, 106, 113, 119; D15/89, D15/91; 62/377
See application file for complete search history.

(56) References Cited

U.S. PATENT DOCUMENTS 338,402 A * 3/1886 Griswold ..... 211/65
2,005,939 A * 6/1935 Hibbard, Jr. ..... 211/74
2,074,438 A * 3/1937 Swedman ..... 220/480
2,074,785 A * 3/1937 Gentz ..... 108/134
2,135,878 A * 11/1938 Sekyra, Sr. ..... 62/252
2,776,866 A * 1/1957 Harbison ..... 312/311
2,813,767 A * 11/1957 Berg et al. ..... 312/405.1
2,976,101 A * 3/1961 Rooney ..... 312/300
2,984,533 A * 5/1961 Sundberg ..... 312/408
3,709,576 A * 1/1973 Lemoine ..... 312/321.5
5,100,008 A * 3/1992 O'Herron ..... 211/106
5,513,910 A * 5/1996 Ellingwood et al. ..... 312/405.1
5,567,029 A * 10/1996 Haenisch et al. ..... 312/405.1
5,909,937 A 6/1999 Jenkins et al.
6,055,823 A 5/2000 Baker et al.
6,068,142 A 5/2000 Primiano
6,386,379 B1 * 5/2002 Battaglia ..... 211/106
6,412,647 B1 * 7/2002 Ko ..... 211/106

FOREIGN PATENT DOCUMENTS

DE 3428504 * 2/1986
EP 580962 * 2/1994
EP 974796 * 1/2000

* cited by examiner

*Primary Examiner*—James O. Hansen
(74) *Attorney, Agent, or Firm*—George L. Rideout, Esq.; Armstrong Teasdale LLP

(57) ABSTRACT

A storage module for a refrigeration appliance that includes a base including opposing side supports and a rack coupled to the side supports by a plurality of hooks, wherein the rack includes at least two opposing cross members.

22 Claims, 7 Drawing Sheets

REFRIGERATOR DOOR BEVERAGE STORAGE MODULE

BACKGROUND OF THE INVENTION

This invention relates generally to refrigerators and more particularly, to a refrigerator door beverage storage module.

Some known refrigeration appliances, including refrigerators and freezers, typically include a cabinet housing including an outer case and one or more inner liners therein that defines a refrigeration compartment, such as a fresh food compartment and a freezer compartment for storing food and beverage items. Typically the fresh food compartment and freezer compartments are closed by separate access doors hingedly attached to the case. A number of storage shelves, bins, and drawers are employed in the fresh food compartment and the freezer compartment to organize food.

Furthermore, storage shelves and bins are often integrated into the refrigerator access doors for storage of food and beverage items. Thus, for example, condiments and bottles may be stored in the fresh food compartment door, and frozen juice concentrates and frozen vegetables may be stored in the freezer compartment door. As such, the items in the door storage shelves and bins are accessible apart from the fresh food and freezer compartments when the doors are opened yet located in the refrigeration compartments when the doors are closed.

In some types of side-by-side refrigerators, multiple storage shelves and bins are integrated in a horizontally stacked orientation relative to one another. The size of the shelves and the spacing between them, however, can be restrictive for loading and unloading items to and from the storage bins. Larger items and/or oddly shaped items, such as a 2-litre bottle, are therefore some times difficult to load and unload from the storage door shelves, and several manipulations of the items may be made to fit items into and remove the items from the storage door. For example, taller items, such as wine bottles, interfere with storage shelves above them and are tilted about their lower ends to fit them into door storage bins and then rotated back to a level position in the bins. Placing these items horizontally may reduce the interference and utilized previously unused space. Smaller items, such as beverage cans, may not be loaded or unloaded with one smooth movement either, but rather are positioned in the door storage shelves with both a horizontal movement and a vertical movement. Loading multiple smaller items would require stacking or positioning that may lead to the items becoming dislodged when the access doors are opened and closed. Still further, access door storage shelves can be difficult to clean.

The aforementioned difficulties are more pronounced when shelves and bins are located in lower portions of the door where they are neither easily reached nor in a clear line of sight for the user.

BRIEF DESCRIPTION OF THE INVENTION

In one aspect, a storage module for a refrigeration appliance is provided, the storage module includes a base comprising opposing side supports and a rack coupled to the side supports by a plurality of hooks, wherein the rack includes at least two opposing cross members.

In another aspect, a storage module for a dairy bin of an access door of a refrigeration appliance is provided, the storage module includes a module base including first and second side supports that are configured for attachment to the access door, at least one boss extending outwardly from one of the first and second side supports, and a storage rack coupled to the module base that includes a wire frame including a plurality of vertical support members, a plurality of bottom members extending from the vertical support members, and a plurality of opposing cross members extending between the bottom members.

In another aspect, a refrigeration appliance is provided, the refrigeration appliance includes a cabinet, a refrigeration compartment liner within the cabinet, wherein the liner includes at least one refrigeration compartment, and at least one access door coupled to the cabinet sized to close the refrigeration compartment, and wherein the access door includes at least one bin side support. The refrigeration appliance also includes at least one dairy bin coupled to the access door bin side support, wherein the bin includes a first and a second side support and a floor extending therebetween, the side supports including a slot that is sized to attach to the access door bin side supports. The refrigeration appliance also includes a beverage storage module coupled to the dairy bin side support, wherein the storage module includes at least one boss extending outwardly from a module base and a wire rack received in the boss, wherein the rack includes a frame that includes a plurality of vertical support members, a plurality of bottom members extending from the vertical support members, and a plurality of opposing cross members coupled to and extending between the bottom members. The refrigeration appliance further includes at least one front member and at least one rear member, wherein the front member extends between a front portion of the bottom members, and wherein the rear member extends between a lower portion of the vertical support members configured to maintain the beverage storage module in an upright position.

DETAILED DESCRIPTION OF THE INVENTION

Figure 1:
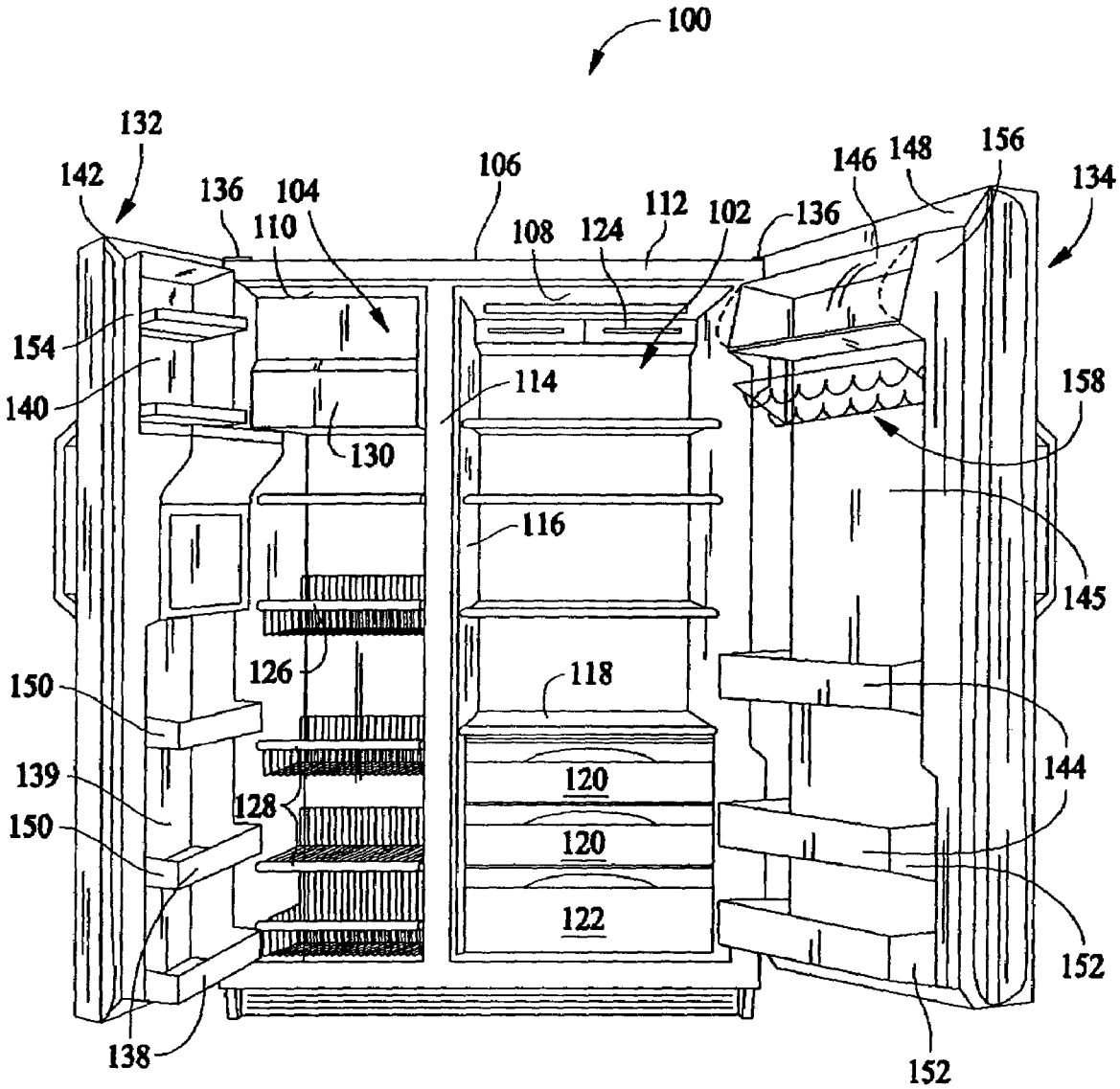
FIG. 1 is a front perspective view of an exemplary refrigerator.

FIG. 1 illustrates an exemplary refrigeration appliance 100. In the embodiment described and illustrated herein, appliance 100 is a side-by-side refrigerator. It is recognized, however, that the benefits of the herein described apparatus are equally applicable to other types of refrigerators, freezers, and refrigeration appliances. Consequently, the description set forth herein is for illustrative purposes only and is not intended to be limiting.

Refrigerator 100 includes a fresh food storage compartment 102 and a freezer storage compartment 104. Freezer compartment 104 and fresh food compartment 102 are arranged side-by-side within an outer case 106 and defined by inner liners 108 and 110 therein. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners 108, 110. Breaker strip 112 is formed from a suitable resilient material, such as an extruded acrylo-butadiene-styrene (ABS) based material.

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out storage drawers 120, sometimes referred to as storage pans, normally are provided in fresh food compartment 102 to support items being stored therein.

Refrigerator 100 is controlled by a microprocessor (not shown) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

In accordance with known refrigerators, refrigerator 100 includes a machinery compartment (not shown) that at least partially contains components for executing a known vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown in FIG. 1). Collectively, the vapor compression cycle components in a refrigeration circuit, associated fans, and associated compartments are referred to herein as a scaled system. The construction of the sealed system is well known and therefore not described in detail herein, and the sealed system is operable to force cold air through the refrigerator.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138, a bin 140, and a sealing gasket 142, and fresh food door 134 also includes a plurality of storage shelves 144, a bin 146, and a sealing gasket 148. In the exemplary embodiment, bin 146 is a dairy bin.

Door shelves 138, 144 and bins 140, 146 are formed into respective access doors 132, 134 and are partly defined by shelf supports 150, 152 and wall supports 154, 156, respectively depending inwardly from each access door 132, 134 such that when access doors 132, 134 are closed, door bins 140, 146 and shelves 138, 144 and are located within freezer compartment 104 and fresh food compartment 102, respectively. Door bins 140, 146 and shelves 138, 144 are further defined by inner door surfaces 139, 145, respectively and are vertically aligned in a stacked arrangement to increase refrigeration compartment space.

When refrigerator 100 is well stocked with food items, door shelves 138, 144 located in upper and lower portions of access doors 132, 134, however, can be difficult to load beverage food items, such as beverage cans, wine bottles, and 2-litre bottles, therein and difficult to unload items therefrom due to relatively close proximity to one another and an obstructed view of lower shelves 138, 144 by upper shelves 138, 144. Placement into and retrieval of items from door shelves 138, 144 often entails a series of awkward, disjointed movements. These difficulties are largely overcome with a beverage storage module 158 attached to door side supports 156. As explained more fully below, beverage storage module 158 is positioned such that it provides direct line of access and clear visibility that facilitates placement of items into beverage storage module 158 and easy retrieval of items from beverage storage module 158 without awkward and complicated movements or dislodgment of beverage storage module 158.

Figure 2:
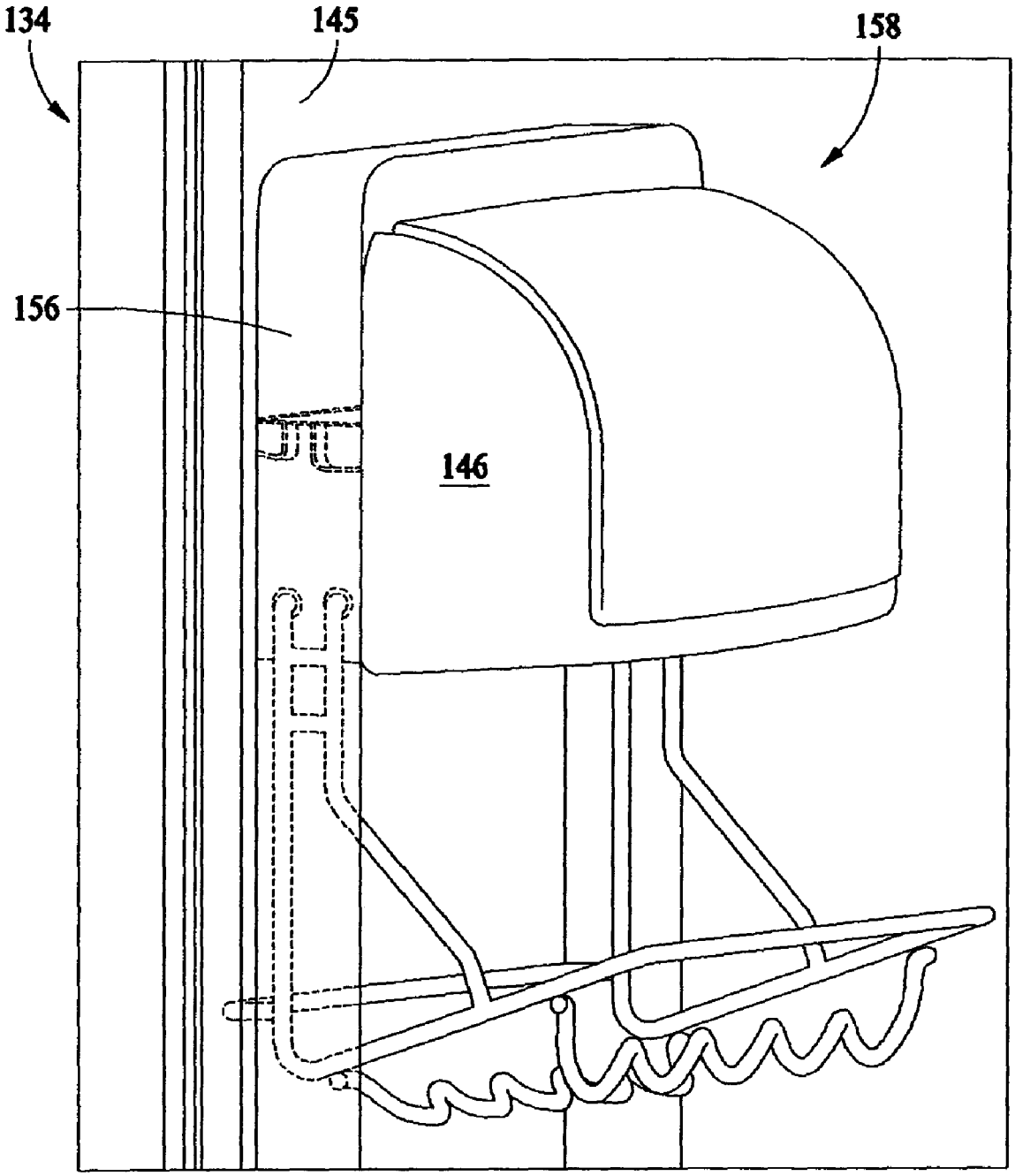
FIG. 2 is a front perspective assembly view of a beverage storage module for the refrigerator shown in FIG. 1.

FIG. 2 is front perspective view of an upper portion of fresh food door 134 of refrigerator 100 (shown in FIG. 1) including single beverage storage module 158 coupled to dairy bin 146 located on the inner surface thereof. It is anticipated that a plurality of beverage modules 158 may employed in freezer door 132 (shown in FIG. 1) and/or fresh food door 134 to increase user convenience and customer satisfaction. For example, in illustrative embodiments, one, two, three, or four beverage storage modules 158 are employed in a single access door, although even greater numbers of modules 158 may be employed. Also, while it is appreciated that the benefits of the herein described apparatus are most apparent in dairy bin 146 in the upper portion of access door 134, beverage storage module 158 may be beneficial when employed in the lower portion of access doors 132, 134 as well. As such, the embodiment shown in FIGS. 1 and 2 are provided for illustrative purposes only, and in no way is intended to be restricted to practice in any particular access door or in any particular location in a refrigeration compartment.

Figure 3:
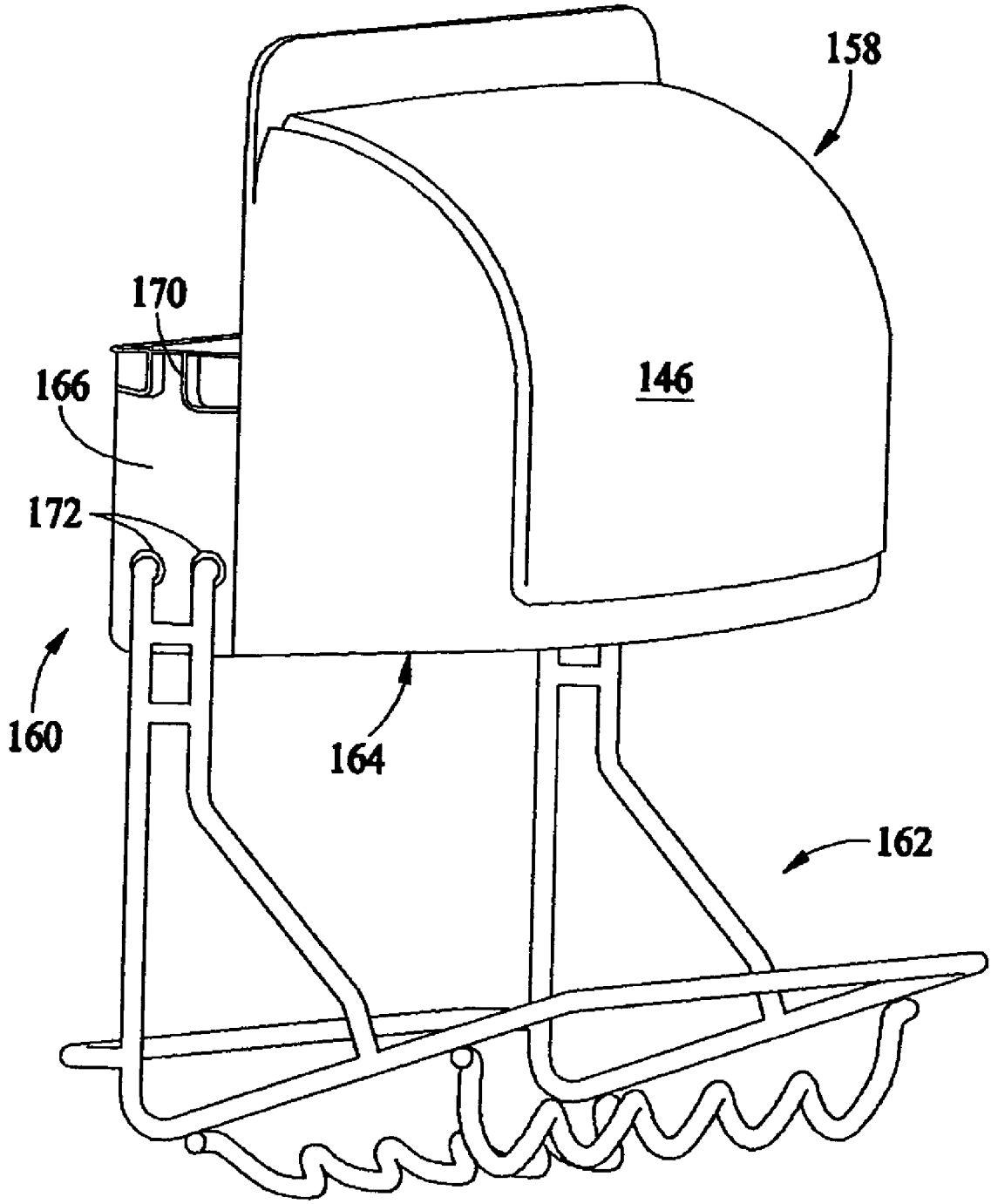
FIG. 3 is a front perspective view of a beverage storage module shown in FIG. 2.

FIG. 3 is a front perspective assembly view of beverage storage module 158 including a module base 160 and a storage rack 162 coupled thereto. Module base 160 includes a bottom or floor 164 extending horizontally and side supports 166 extending vertically upward from opposite lateral ends of module floor 164 forming a substantially rectangular shape. Each base side support 166 includes a slot 170 that receives a complementary projection of an access door wall support, such as supports 154, 156 (shown in FIG.

1) with press fit engagement. Storage rack 162 is coupled to base side supports 166 via a plurality of bosses 172 (described further below) that allow rack 162 to be suspended such that rack 162 is vertically aligned relative to module base 160 for direct access and a generally unobstructed line of sight into rack 162, even when rack 162 is located in a lower portion of an access door, such as doors 132, 134 (shown in FIG. 1).

Figure 4:
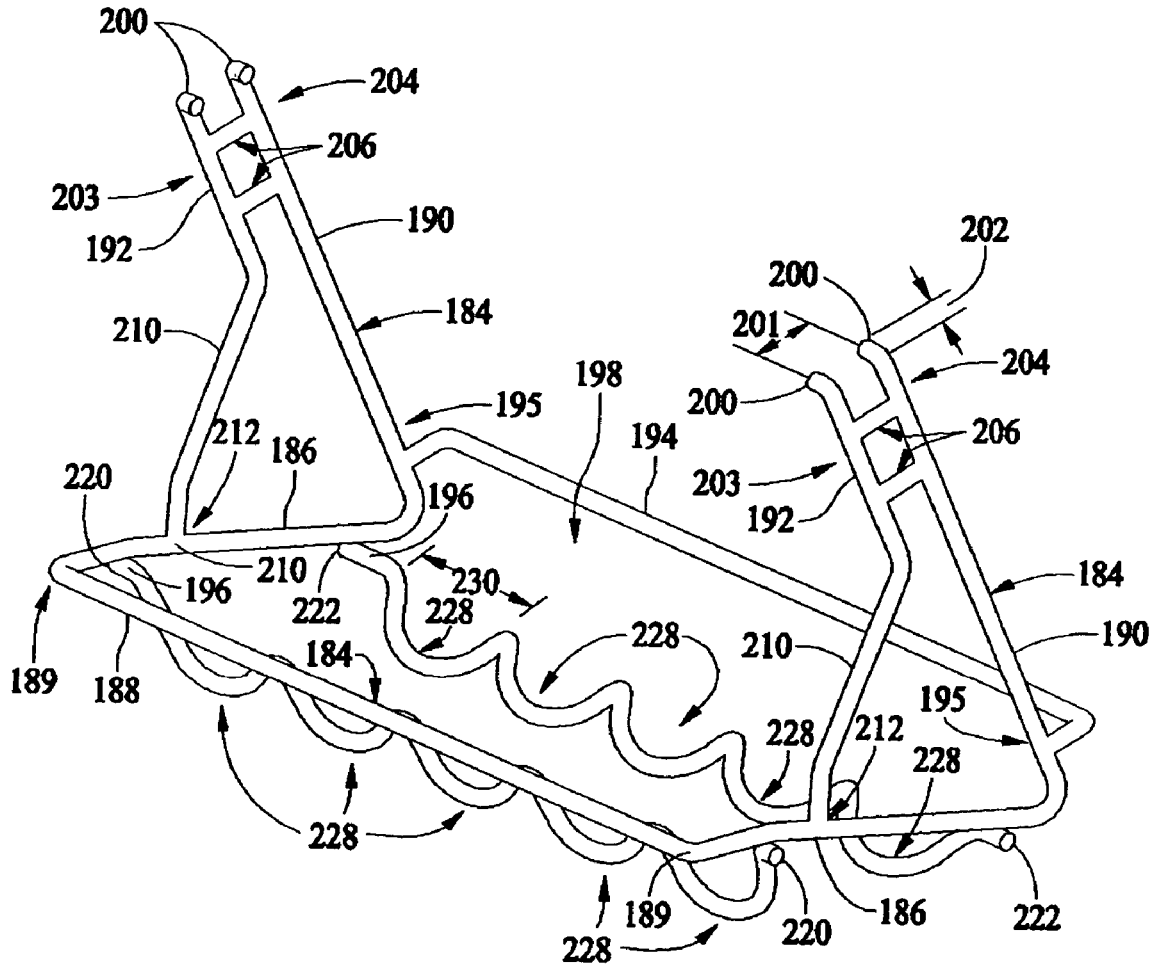
FIG. 4 is a front perspective view of a storage rack shown in FIG. 3.
Figure 5:
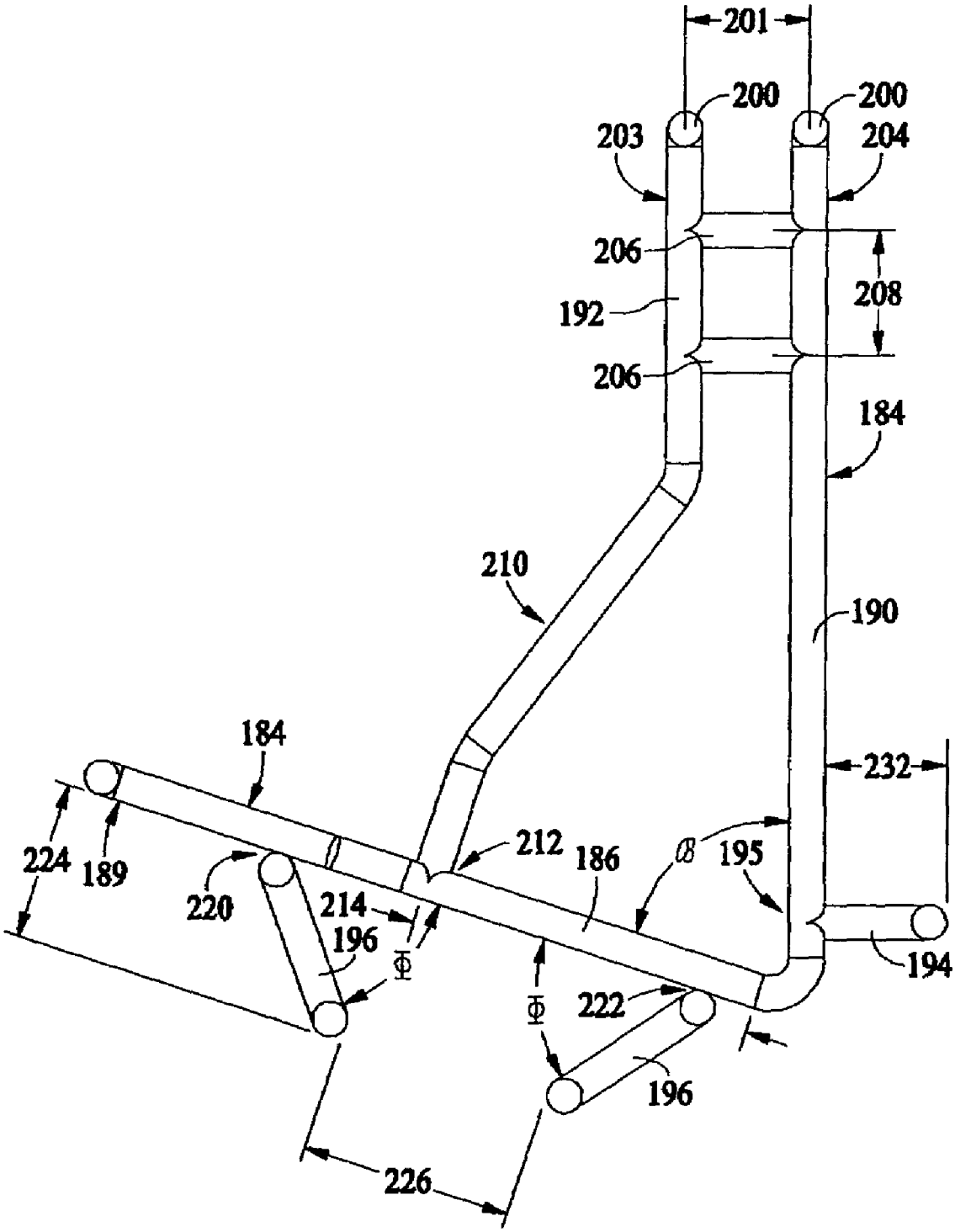
FIG. 5 is a side view of the storage rack shown in FIG. 4.

FIG. 4 is a front perspective view of storage rack 162. FIG. 5 is a side view of storage rack 162. Storage rack 162 includes a frame 184 including a plurality of spaced apart bottom members 186, at least one front member 188 extending from a plurality of front portions 189 of spaced apart bottom members 186, and a plurality of spaced apart vertical support members 190 extending upward from bottom members 186. Bottom members 186 extend at an angle β from vertical support members 190. In an exemplary embodiment, β is 70°. In one embodiment, P is between 60° and 80°. In another embodiment, β is between 50° and 90°. It is appreciated that greater or lesser degrees of angle β may be facilitated in alternative embodiments.

Frame 184 further includes a plurality of front support members 192 positioned substantially parallel to vertical support members 190 and at least one rear member 194 extending from a plurality of lower portions 195 of vertical support members 190. A plurality of S-shaped cross members 196 extend between bottom members 186, thereby forming an open rectangular-shaped basket container 198.

In an exemplary embodiment, storage rack 162 is formed from a suitable resilient metallic material, such as cold-rolled steel. In another embodiment, storage rack 162 is formed from a suitable resilient metallic material, such as stainless-steel. In an alternative embodiment, storage rack 162 is formed from a suitable resilient non-metallic material, such as ABS. In the exemplary embodiment, frame 184 is formed from bending a unitary member and welding additional members in place. In an alternative embodiment, storage rack 162 is constructed entirely from welding separate members together.

A plurality of hooks 200 are spaced apart a distance 201 measured from center-to-center and extend 90° a distance 202 from top portions 203, 204 of vertical support members 190 and front support member 192, respectively. In one embodiment, distance 201 is 0.800 inches and distance 202 is 0.511 inches. In another embodiment, distance 201 is approximately between 0.600 inches and 1.000 inches and distance 202 is approximately between 0.300 inches and 0.700 inches. Hooks 200 are each received into bosses 172 located on a lower portion (described below) of each module base side support 166 (shown in FIG. 3). As such, rack 162 is secured to base module 160 (shown in FIG. 3) when hooks 200 extend into bosses 172, thereby securing rack 162 during opening and closing of access doors 132, 134 (shown in FIG. 1). Rack 162 is resilient and disforms under applied outward horizontal stress in order to insert hooks 200 into bosses 172 and then reforms to resiliently maintain hooks 200 in bosses 172. As such hooks 200 are under horizontal tension while engaging bosses 172, thereby preventing basket 162 from dislodging during both shipment and accidental contact while placing and retrieving items from compartments 102, 104 (shown in FIG. 1).

A plurality of spaced apart ribs 206 are fixedly attached horizontally between top portions 203, 204 of vertical support members 190 and front support member 192, respectively. In an exemplary embodiment, two ribs 206 are welded between members 190 and 192. Ribs 206 are spaced a distance 208. In one embodiment, distance 208 is 1.000 inches. In another embodiment, distance 208 is approximately between 0.600 inches and 1.400 inches. Each front support member 192 includes a forward projecting support member 210 fixedly attached to an attachment point 212. In the exemplary embodiment, ribs 206 and supports 210 are positioned, dimensioned, and oriented to prevent distortion of rack 162, although it is appreciated that greater or lesser distances 208 may be facilitated in alternative embodiments depending on the size of the doors 132, 134 (shown in FIG. 1) and the location of the bins 140, 146 (shown in FIG. 1).

A plurality of cross members 196 are fixedly attached between bottom members 186 to a front attachment point 220 and a back attachment point 222 and provide support for beverage items placed on to rack 162. Cross members 196 extend a distance 224 from bottom member 186 and are spaced apart from each other a distance 226, as such beverage items can be secured between cross members 196. In one embodiment, distance 224 is 1.173 inches and distance 226 is 1.820 inches. In another embodiment, distance 224 is approximately between 0.800 inches and 1.600 inches and distance 226 is approximately between 1.400 inches and 2.200 inches. In one embodiment, two cross members 206 are welded between bottom members 186 at attachment points 220, 222.

Cross members 196 are configured to receive beverage items both parallel to and perpendicular to the orientation of cross members 196, as such rack 162 can accommodate beverage items that vary in diameter. Each cross member 196 comprises a plurality of substantially arcuate sections 228, as such each section is aligned with a companion section 228 on the opposite cross member 196. In the exemplary embodiment, each cross member 196 includes five sections 228. In an alternative embodiment, each cross member 196 includes more than five or less than five sections 228. In another alternative embodiment, each cross member 196 has a different number of sections 228. Each section 228 has a diameter 230. In an exemplary embodiment, diameter 230 is 2.600 inches. In another embodiment, diameter 230 is approximately between 2.400 inches and 2.800 inches. In yet another embodiment, diameter 230 is approximately between 2.000 inches and 3.200 inches and sized to secure a variety of food and beverage items to include water bottles, juice bottles, and juice cans. It is appreciated that greater or lesser distances of diameter 230 may be facilitated in alternative embodiments.

Cross members 196 extend downwardly an angle Φ from bottom members 186 and are angled towards each other. In an exemplary embodiment, cross members 196 are dimensioned and oriented to one another approximately 55° to support beverage items. In one embodiment, Φ is between 45° and 65°. In another embodiment, Φ is between 35° and 75°. It is appreciated that greater or lesser degrees of angle Φ may be facilitated in alternative embodiments.

Rear support 194 is fixedly attached between lower portions 195 of vertical support member 190. Rear support 194 extends a distance 232 substantially horizontally from vertical support member 190. In one embodiment, distance 232 is 0.778 inches. In another embodiment, distance 232 is approximately between 0.400 inches and 1.200 inches. Rear support 194 is adjacent door inner surface 145 (shown in FIG. 2) and supports rack 162 in an upright position and facilitates preventing beverage items from contacting door surface 145.

Figure 6:
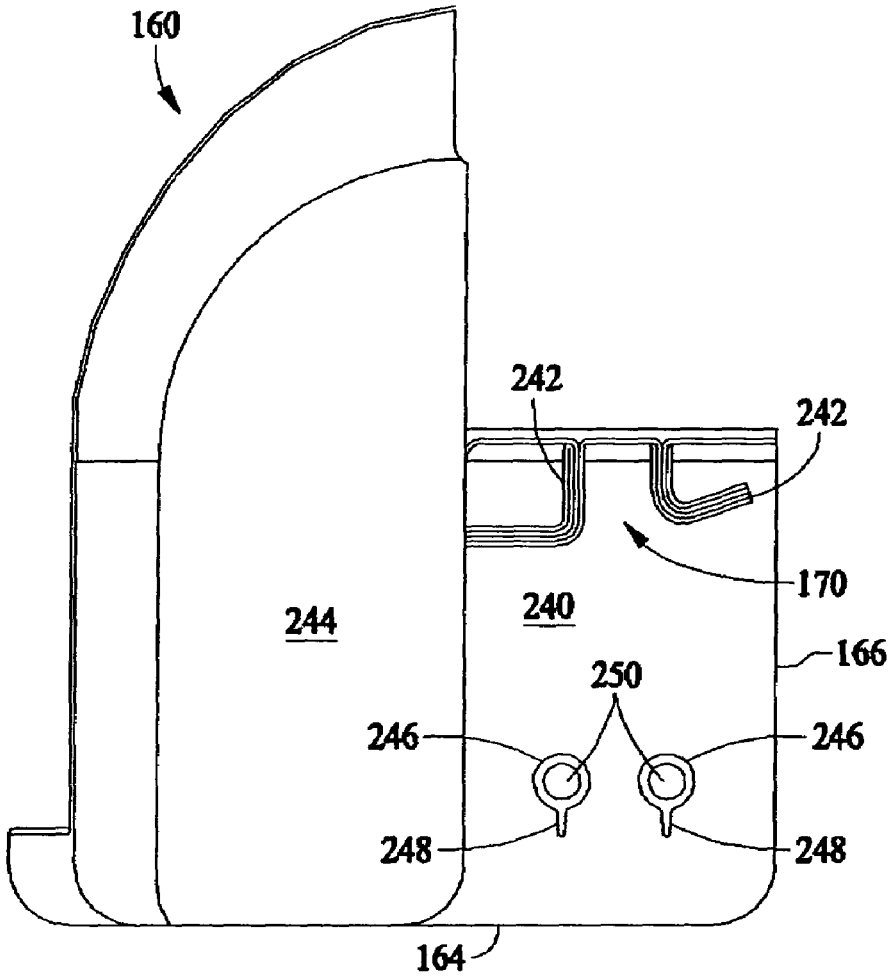
FIG. 6 is a side view of a base module shown in FIG. 3.
Figure 7:
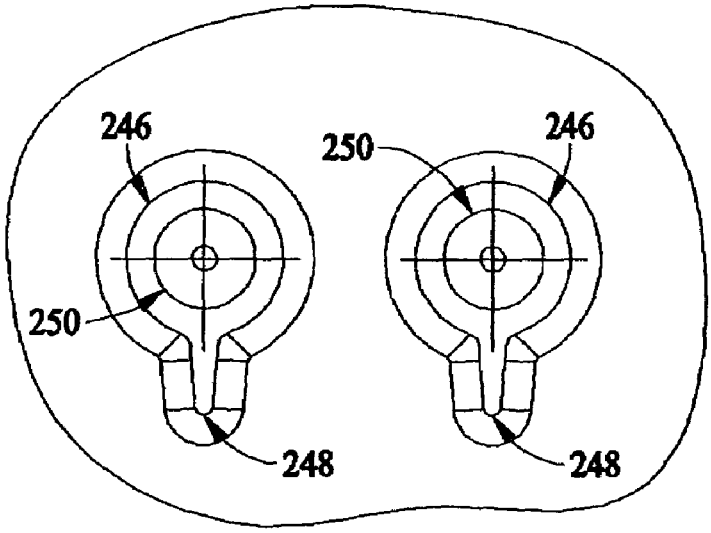
FIG. 7 is a magnified view of a portion of the base module shown in FIG. 6.

FIG. 6 is a side view of module base 160 with rack 162 (shown in FIGS. 4 and 5) removed. FIG. 7 is a magnified view of a portion of one of module base side support rear portions 240 including bosses 172. A generally rectangular door access slot 170 extends from an outer surface of a rear portion 240 of each module base side support 166 in an exemplary embodiment. In the exemplary embodiment, door access slot 170 is defined by outwardly depending projections or ribs 242 depending from an upper portion of an outer surface of side support rear portions 240. Door access slots 170 interface with a square projection of access door shelf supports, such as supports 154 and 156 (shown in FIG. 1), to securely couple module base 160 to an access door, such as doors 132, 134 (shown in FIG. 1) with a sliding engagement that facilitates both hand installation and hand removal of module base to and from an access door without tools.

A front portion 244 of each side support extends from rear portions 240 and is thicker than rear portions 240 such that rear portions 240 are recessed relative to front portions 244 and therefore not visible when module base 160 is installed in a refrigeration appliance access door, such as doors 132, 134 (shown in FIG. 1). Front portions 244 are contoured to provide a pleasing appearance of module base 160.

Generally circular bosses 172 extend from a lower portion of rear portion 240 but not beyond front portion 244 and therefore not visible when module base 160 is installed. When rack 162 is attached to module 160, vertical support members 190 (shown in FIGS. 4 and 5) and front support members 192 (shown in FIGS. 4 and 5) are substantially flush with rear portion 240.

In an exemplary embodiment, module base 160 is fabricated with known plastic materials according to known methods and techniques, including but not limited to injection molding processes.

Each boss 172 is defined by an outwardly depending circular head portion 246 and a neck portion 248 extending downward toward base floor 164. Each head portion 246 includes an opening 250 centered and extending inward toward rear portion 240, such that hooks 200 (shown in FIGS. 3 and 4) can be horizontally stretched and snap fit into each boss opening 250. Each boss opening 250 is dimensioned to receive a hook 200 and neck portion 248 is dimensioned to strengthen head portion 246. Thus, when hooks 200 are inserted into bosses 172, boss head 246 and boss neck 248 support the combined weight of rack 162 (shown in FIG. 4) and inserted beverage items. Once in this position, rack 162 is not easily removed from boss 172, thereby avoiding undesirable inadvertent disassembly of beverage module 158 during shipment and allowing beverage module 158 to survive impact when accidentally bumped.

Figure 8:
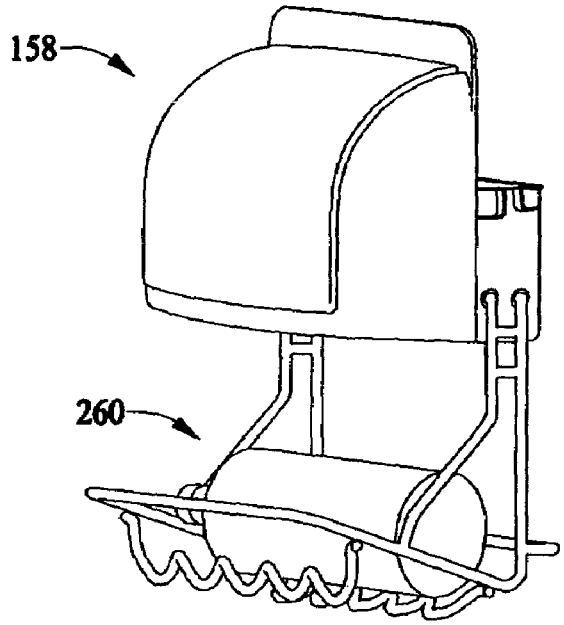
FIG. 8 is a front perspective view of a beverage storage module including a 2-litre bottle.
Figure 9:
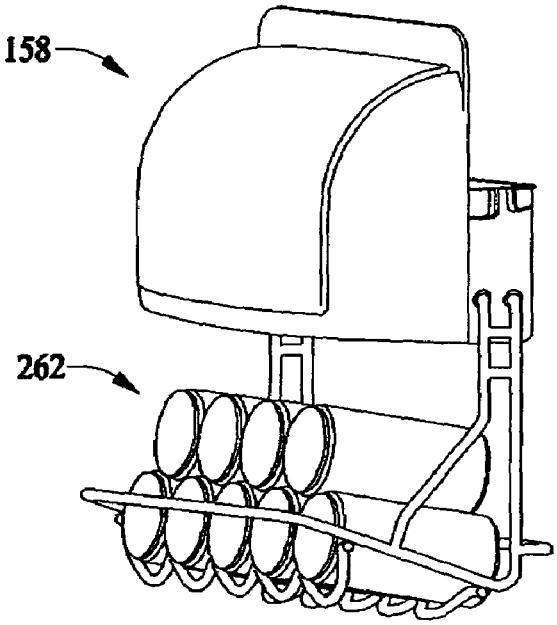
FIG. 9 is a front perspective view of a beverage storage module including a nine beverage cans.
Figure 10:
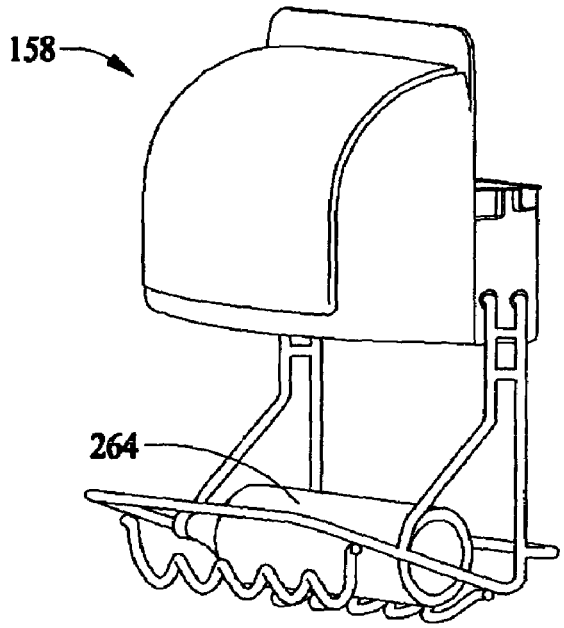
FIG. 10 is a front perspective view of a beverage storage module including a wine bottle.

FIG. 8 is a front perspective view of beverage storage module 158 including a 2-litre bottle 260. FIG. 9 is a front perspective view of beverage storage module 158 including a plurality of beverage cans 262. In the exemplary embodiment, module 158 includes is configured to accommodate at least nine beverage cans 262. In another embodiment, module 158 is configured to accommodate at least twelve beverage cans 262. FIG. 10 is a front perspective view of beverage storage module 158 including a wine bottle 264. While it is appreciated that the benefits of the herein described embodiments are most apparent for use with 2-litre bottle 260, a plurality of beverage cans 262, and wine bottle 264, beverage module 158 may be dimensioned so as to accommodate items of different sizes such as, but not limited to, baby food jars, reduced size beverage cans, twenty ounce bottles, and frozen juice cans.

A low cost and easily assembled beverage module 158 is therefore provided to facilitate loading and unloading of access door storage shelves and bins with a direct and clear line of sight and access when rack 162 is installed. The modular unit is easily installed and removed from the access door for cleaning, maintenance, and service.

While the invention has been described in terms of various specific embodiments, those skilled in the art will recognize that the invention can be practiced with modification within the spirit and scope of the claims.

What is claimed is:

1. A storage module for a refrigeration appliance, said storage module comprising:

a base comprising opposing side supports configured to removably attach said base to an access door of the refrigerator appliance; and a rack for holding articles, said rack removably coupled to an outer surface of said side supports by a plurality of vertical support members and a plurality front support members, each of said vertical support members and each of said front support members comprising a hook coupled to a corresponding side support such that said rack is secured in a fixed orientation to said base, and said base is disposed between said plurality of vertical support members and between said plurality of front support members, said rack comprising at least two opposing cross members.

2. A storage module in accordance with claim 1 wherein said rack further comprising a wire frame comprising the hook extending from each of said vertical support members and the hook extending from each of said front support members and a plurality of bottom members extending from said vertical support members and from said front support members.

3. A storage module in accordance with claim 2 wherein said rack further comprising at least one front member and at least one rear member, said front member extending between a front portion of each said bottom member, said rear member extending between a lower portion of each said vertical support member configured to maintain said rack in an upright position.

4. A storage module in accordance with claim 2 wherein said cross members are coupled to said bottom members by at least a weld.

5. A storage module in accordance with claim 2 wherein said base further comprises a plurality of bosses formed on said base side supports, said bosses configured to receive said hooks.

6. A storage module in accordance with claim 1 wherein said rack is configured to receive a first beverage container in a first direction and a second beverage container in a second direction perpendicular to said first direction.

7. A storage module in accordance with claim 1, said cross members comprising a plurality of arcuate sections.

8. A storage module in accordance with claim 1 wherein said cross members comprise at least five sections, each said section comprising an arc of a circle with a diameter sized between about 2.0 inches and 3.0 inches in diameter.

9. A storage module in accordance with claim 1 wherein said cross members are oriented relative to at least two bottom support members of said rack at about 55°.

10. A storage module for an access door of a refrigeration appliance, said storage module comprising:

a module base comprising first and second side supports, said first and second side supports configured to removably attach said module base to the access door;

a plurality of bosses extending outwardly from each of said first and second side supports; and a storage rack comprising a wire frame comprising a plurality of vertical support members, a plurality of front support members, a plurality of bottom members extending from said vertical support members and from said front support members, and a plurality of opposing cross members extending between said bottom members, said storage rack removably coupled to an outer surface of said module base such that said module base is disposed between said plurality of vertical support members and said plurality of front support members, each of said vertical support members and each of said front support members comprising a hook, said hook positioned within a corresponding boss of said plurality of bosses such that said rack is secured in a fixed orientation to said base.

11. A storage module in accordance with claim 10, said storage rack further comprising at least one front member and at least one rear member, said front member extending between a front portion of said bottom members, said rear member extending between a lower portion of said vertical support members configured to maintain said rack in an upright position.

12. A storage module in accordance with claim 10 wherein said bottom members are oriented relative to said vertical support members at about 70.

13. A storage module in accordance with claim 10 wherein said cross members are oriented relative to said bottom members at about 55.

14. A storage module in accordance with claim 10 wherein said cross members comprise a plurality of equally sized arcuate sections.

15. A storage module in accordance with claim 10 wherein said rack is configured to receive a first beverage container in a first direction and a second beverage container in a second direction perpendicular to said first direction.

16. A storage module in accordance with claim 10 wherein vertical support members comprise a plurality of hooks for attaching said rack to said module base.

17. A storage module in accordance with claim 16 wherein said module base further comprises a plurality of bosses formed on said base side supports, said bosses configured to receive said hooks.

18. A refrigeration appliance comprising:

a cabinet;

a refrigeration compartment within said cabinet;

at least one access door coupled to said cabinet sized to close said refrigeration compartment, said access door comprising at least one access door wall support; and a beverage storage module coupled to said access door wall support, said storage module comprising:

a first and a second side support and a floor extending therebetween, said side supports including a slot sized to attach to said beverage storage module to said access door wall supports; and a wire rack coupled to said side supports, said rack comprising:

a frame comprising a plurality of vertical support members, a plurality of bottom members extending from said vertical support members, and a plurality of opposing cross members coupled to and extending between said bottom members, wherein said side supports are disposed between at least two of said vertical support members; and at least one front member and at least one rear member, said front member extending between a front portion of said bottom members, said rear member extending between a lower portion of said vertical support members configured to maintain said beverage storage module in an upright position.

19. A storage module in accordance with claim 18 wherein each said cross member comprises at least five equally sized arcuate sections.

20. A storage module in accordance with claim 18 wherein each cross member is sized to receive a first beverage container in a first direction and a second beverage container in a second direction perpendicular to said first direction.

21. A storage module for a refrigeration appliance, said storage module comprising:

a base comprising opposing side supports configured to removably attach said base to an access door of the refrigerator appliance, said base further comprising at least two bosses formed on said side supports; and a rack for holding articles coupled to said side supports by a plurality of vertical support members and a plurality of front support members such that said base is disposed between said plurality of vertical support members and between said plurality of front support members, said rack comprising at least two opposing cross members, said rack further comprising a wire frame comprising a hook extending from each of said vertical support members and from each of said front support members, and coupled to a corresponding side support such that said rack is secured in a fixed orientation to said base, and a plurality of bottom members extending from said vertical support members, said bosses configured to receive said hooks.

22. A storage module for an access door of a refrigeration appliance, said storage module comprising:

a module base comprising first and second side supports, said first and second side supports configured to removably attach said module base to the access door;

a plurality of bosses extending outwardly from each of said first and second side supports; and a storage rack comprising a wire frame comprising a plurality of vertical support members and a plurality of front support members, said plurality of vertical support members and said plurality of front support members comprising a hook, said hook positioned within a corresponding boss of said plurality of bosses such that said rack is secured in a fixed orientation to said module base, a plurality of bottom members extending from said vertical support members, and a plurality of opposing cross members extending between said bottom members, said storage rack coupled to said module base such that said module base is disposed between said plurality of vertical support members and between said plurality of front support members.

* * * * *